US006165022A

United States Patent [19]

Wu

[11] Patent Number: 6,165,022

[45] Date of Patent: Dec. 26, 2000

[54] ELECTRICAL CONNECTOR WITH BOTTOM LOADED SPACER

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/337,860

[22] Filed: Jun. 21, 1999

[30] Foreign Application Priority Data

Dec. 31, 1998 [TW] Taiwan ..... 87222070

[51] Int. Cl.[7] ..... H01R 24/00

[52] U.S. Cl. ..... 439/676; 439/344

[58] Field of Search ..... 439/676, 344, 439/541.5, 79, 80, 188

[56] References Cited

U.S. PATENT DOCUMENTS 5,397,250 3/1995 Briones ..... 439/620

5,405,268 4/1995 Gazzara et al. ..... 439/188

5,766,043 6/1998 Talend ..... 439/676

*Primary Examiner*—Brian Sircus

*Assistant Examiner*—Son V. Nguyen

*Attorney, Agent, or Firm*—Wei Te Chung

[57] ABSTRACT

An electrical connector includes a housing, a molded spacer received in the housing and a shell covering the housing. The molded spacer includes a receiving board and a terminating board perpendicularly extending from one end of the receiving board. The housing has a front opening for insertion of a complementary connector and a bottom opening in communication with the front opening for receiving the receiving board of the molded spacer. The housing forms a planar board on an inner surface of opposite side walls thereof to define a receiving space with a rear wall thereof. The inner surface of each side wall forms a cutout in communication with the bottom opening for receiving the terminating board of the molded spacer.

9 Claims, 3 Drawing Sheets

ELECTRICAL CONNECTOR WITH BOTTOM LOADED SPACER

BACKGROUND OF THE INVENTION

1. Field of the Invention

The present invention relates to an electrical connector, especially to a connector having a molded spacer which is inserted into a housing of the connector from a bottom of the housing.

2. Description of Prior Art

As the trend of the computer industry continues toward miniaturization, electrical connectors of reduced volume are desired. A conventional connector, such as disclosed in Taiwan Patent Application Nos. 83212694 and 84101576, has a housing and a molded spacer inserted into the housing from a rear of the housing. The housing has top and bottom walls forming a plug opening for insertion of a complementary connector to implement electrical connection. However, the height of the electrical connector is increased due to the provision of the top and bottom walls. It is also desired to simplify assembly process of the electrical connector and improve the reliability thereof.

SUMMARY OF THE INVENTION

Accordingly, an object of the present invention is to provide an electrical connector having a reduced height and simplified structure.

In the preferred embodiment of the present invention, an electrical connector comprises a housing and a molded spacer received in the housing. The housing has a front opening for insertion of a complementary connector and a bottom opening in communication with the front opening. The molded spacer is received in the bottom opening.

BRIEF DESCRIPTION OF THE DRAWINGS

Other objects and advantages of the present invention will be understood from the following description of an electrical connector according to a preferred embodiment of the present invention shown in the accompanying drawings, in which.

DETAILED DESCRIPTION OF THE PREFERRED EMBODIMENT

Figure 1:
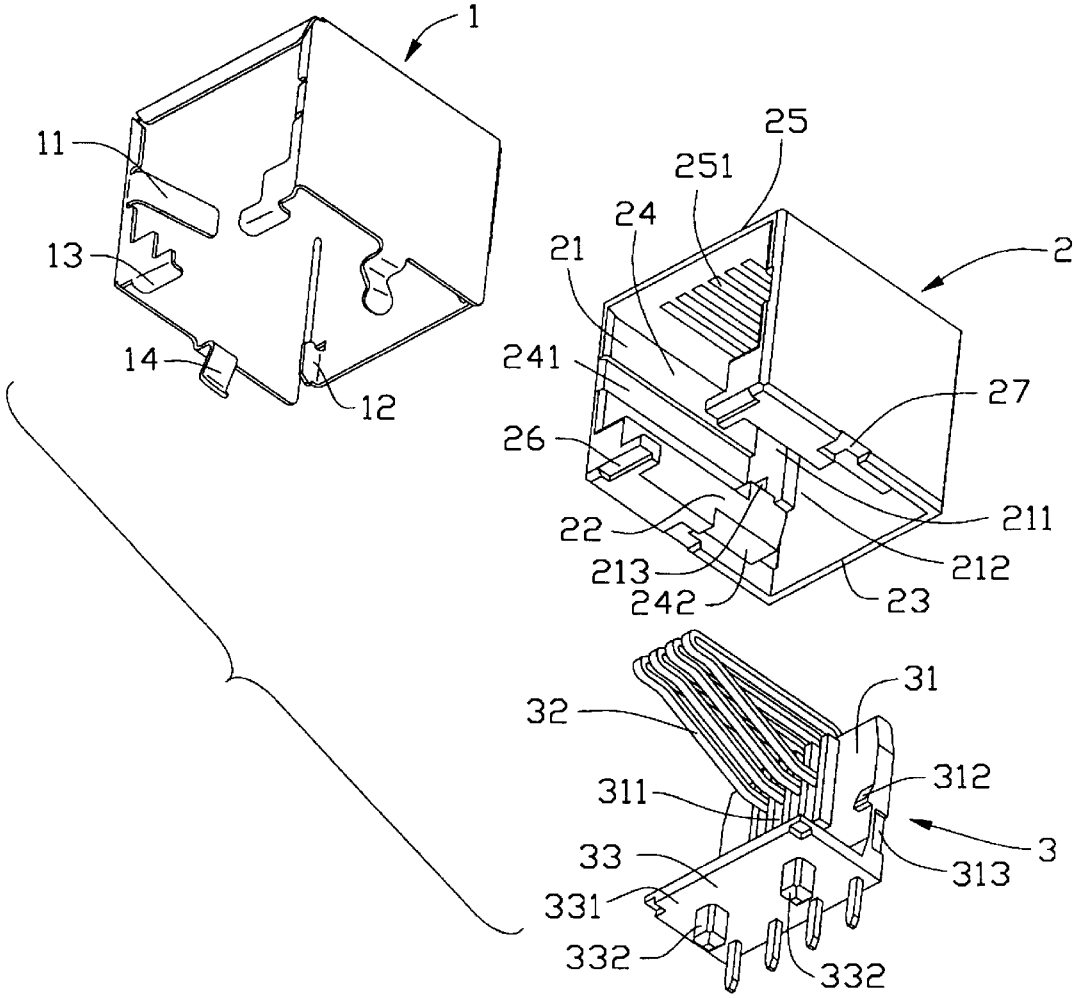
FIG. 1 is an exploded view of an electrical connector embodying the concepts of the present invention.
Figure 2:
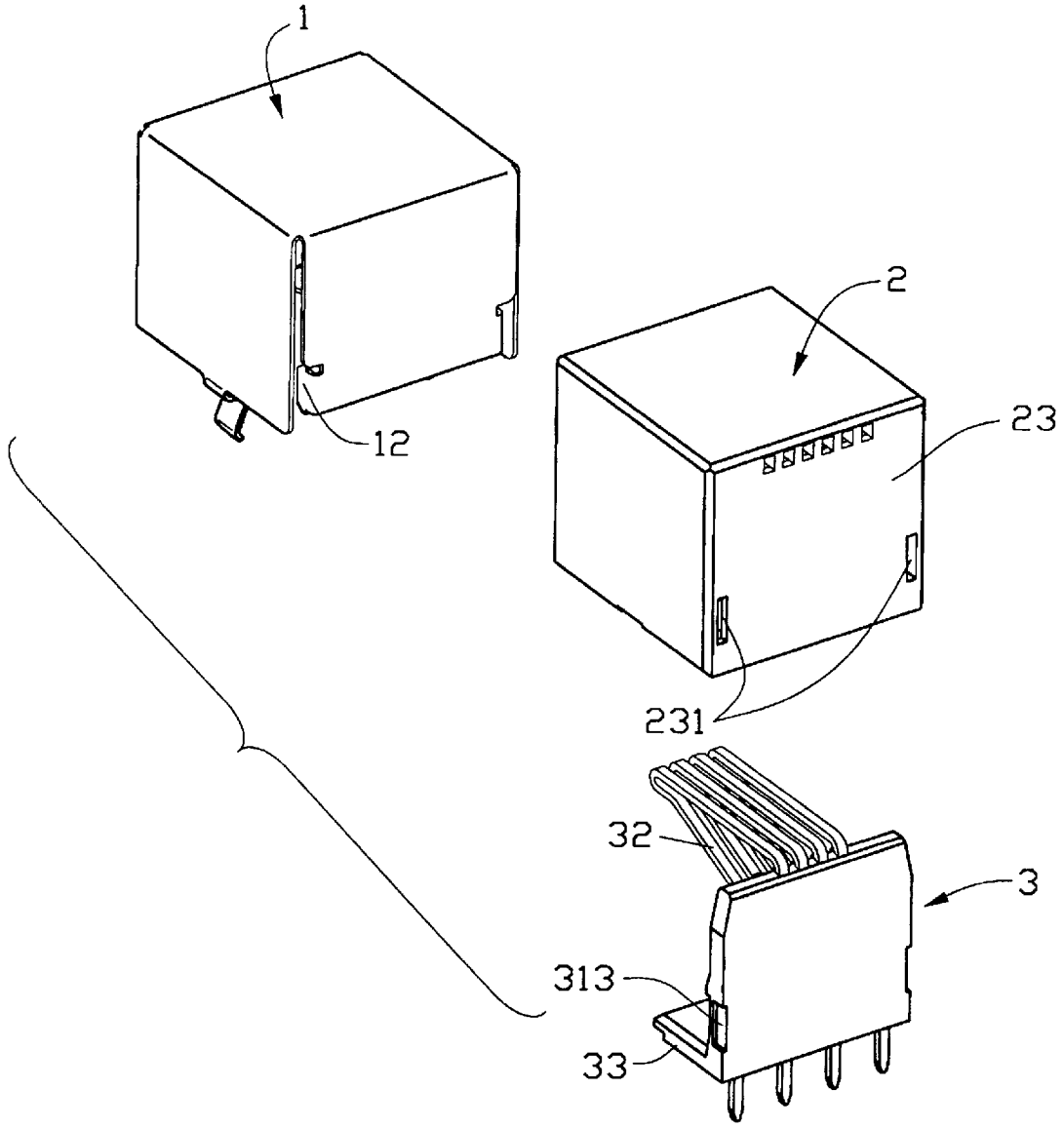
FIG. 2 is similar to FIG. 1 but taken from a different perspective.

Referring to FIGS. 1 and 2, an electrical connector in accordance with the present invention comprises a shell 1, a housing 2 received in the shell 1 and a molded spacer 3 received in the housing 2. The shell 1 has a pair of spring tabs 11 inwardly extending from a front side thereof and a pair of latches 12 inwardly extends from a rear side thereof. A pair of tongues 13 extends from a bottom edge of the front side toward the rear side. A pair of fingers 14 extends downwardly from opposite bottom edges.

The housing 2 comprises a top wall 25, a pair of side walls 24 extending from opposite edges of the top wall 25, and a rear wall 23 between the top and the side walls 25, 24. A front opening 21 for receiving a complementary connector is formed opposite the rear wall 23 and a bottom opening 22 in communication with the front opening 21 is formed opposite the top wall 25. A planar board 211 parallel to the rear wall 23 is formed on an inner surface of each side wall 24 and defines a hole 213 therethrough. Thus, a receiving space 212 is defined between the rear wall 23 and the two planar boards 211. The top wall 25 forms a plurality of grooves 251 in an inner surface thereof. Each side wall 24 defines a recess 241 in an inner surface thereof for receiving the spring tabs 11 of the shell 1, and a cutout 242 in communication with the bottom opening 22. A pair of slots 231 is defined in opposite sides of the rear wall 23 for extension of the corresponding latches 12 of the shell 1. A pair of recessed portions 26 is formed below the front opening 21 for engaging with the tongues 13 of the shell 1. A pair of notches 27 is formed in opposite sides of the bottom opening 22 for resiliently engaging with the fingers 14 of the shell 1.

The molded spacer 3 includes a receiving board 31 for insertion into the receiving space 212 of the housing 2, a plurality of terminals 32 received in the receiving board 31 and a terminating board 33 perpendicularly extending from one end of the receiving board 31. The receiving board 31 defines a plurality of partitions 311 for movably receiving ends of the terminals 32 therebetween. A pair of protrusions 312 project from opposite sides of the receiving board 31 for engaging with the holes 213 of the housing 2. A pair of grooves 313 is defined in the opposite sides of the receiving board 31 for receiving the latches 12 of the shell 1. The terminating board 33 has a terminating surface 331 with a pair of posts 332 extending downwardly therefrom. Tail portions (not labeled) of the terminals 32 for being soldered to a printed circuit board extend downwardly beyond the terminating surface 331.

Figure 3:
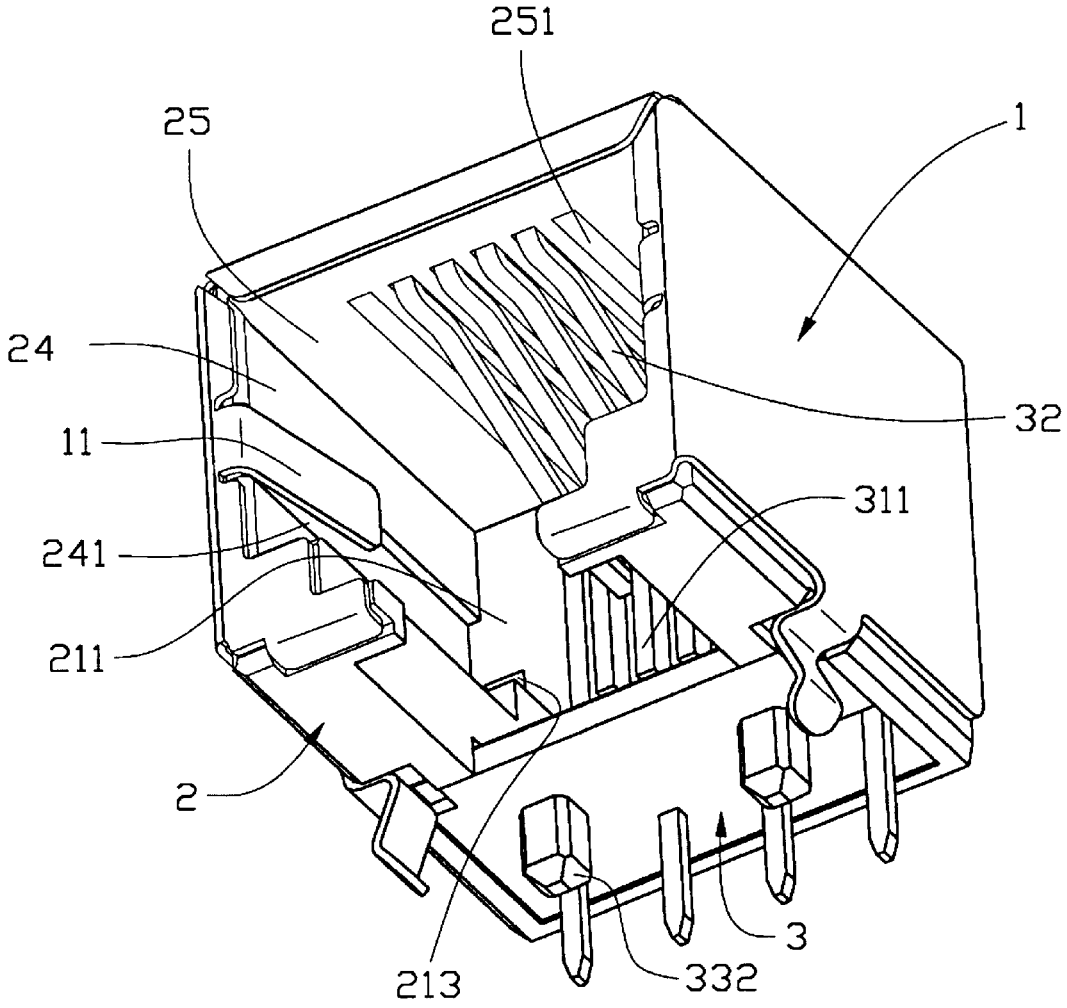
FIG. 3 is an assembled view of FIG. 1.

Referring to FIG. 3, in assembly, the receiving board 31 of the molded spacer 3 is inserted through the bottom opening 22 of the housing 2 and received in the receiving space 212 whereby the protrusions 312 of the molded spacer 3 engage with the holes 213 of the housing 2. Opposite edges of the terminating board 33 are received in the cutouts 242 of the housing 2 and abut against the side walls 24 of the housing 2 thereby reducing the height of the connector by not requiring a bottom wall. A portion of each terminal 32 is received in the groove 251 of the housing 2. The spring tabs 11 of the shell 1 are partially received in the recesses 241 of the housing 2. The latches 12 of the shell 1 extend through the slots 231 of the housing 2 and engage with the grooves 313 of the molded spacer 3. Thus, the assembly process of the connector is simple and reliable.

It will be understood that the present invention may be embodied in other specific forms without departing from the spirit of the central characteristics thereof. The present examples and embodiments, therefore, are to be considered in all respects as illustrative and not restrictive, and the invention is not to be limited to the details given herein.

What is claimed is:

1. An electrical connector comprising:

a housing having a top wall, a rear wall, a pair of side walls, a front opening for insertion of a mating connector, a bottom opening and a planar board formed on an inner surface of each side wall and spaced from the rear wall to define a receiving space; and a spacer comprising a receiving board and a terminating board perpendicular to the receiving board, the spacer being inserted from the bottom opening into the housing with the receiving board received in the receiving space; wherein the spacer retains a plurality of terminals, a plurality of grooves are defined in an inner surface of the top wall to receive the terminals, and the spacer forms a plurality of partitions to movably receive free ends of the terminals.

2. The electrical connector as described in claim 1, wherein each planar board comprises a hole and wherein the spacer comprises a protrusion for engaging with the hole.

3. The electrical connector as described in claim 1, wherein the housing forms a pair of cutouts in the side walls and wherein the terminating board is received in the cutouts.

4. The electrical connector as described in claim 1, wherein the terminating board has a terminating surface and a pair of posts extending from the terminating surface for mounting to a circuit board.

5. The electrical connector as described in claim 1 further including a shell for covering the housing.

6. The electrical connector as described in claim 5, wherein the shell forms a pair of spring tabs for electrically connecting with the mating connector and wherein the housing defines a recess in the inner surface of each side wall for receiving the spring tabs.

7. The electrical connector as described in claim 5, wherein the housing forms a pair of slots in opposite sides of the rear wall, the spacer defines a pair of grooves in opposite sides thereof, and the shell forms a pair of latches extending through the slots and engaging with the grooves.

8. The electrical connector as described in claim 5, wherein a pair of fingers extends from opposite bottom edges of the shell and wherein a pair of notches is formed in opposite sides of the bottom opening for resiliently engaging with the fingers of the shell.

9. The electrical connector as described in claim 5, wherein a pair of tongues extends from a bottom edge of a front side of the shell toward the rear side and wherein a pair of recessed portions is formed below the front opening for receiving the tongues.

* * * * *